United States Patent [19]

Childers

[11] 4,451,382

[45] May 29, 1984

[54] SEWING THREAD LUBRICANTS

[75] Inventor: John T. Childers, Matthews, N.C.

[73] Assignee: Henkel Corporation, Minneapolis, Minn.

[21] Appl. No.: 508,445

[22] Filed: Jun. 27, 1983

[51] Int. Cl.[3] ..... D06M 3/38; D06M 13/00

[52] U.S. Cl. ..... 252/8.6; 106/268

[58] Field of Search ..... 252/8.6; 106/250, 268

[56] References Cited

U.S. PATENT DOCUMENTS

| | | | |
|---|---|---|---|
| 2,403,304 | 7/1946 | Robinson et al. | 252/8.6 |
| 2,978,408 | 4/1961 | Lanner et al. | 252/8.6 |
| 3,397,081 | 8/1968 | Mayberry | 252/8.6 |
| 3,421,935 | 1/1969 | Finch | 252/8.6 |
| 4,169,905 | 10/1979 | Delaval et al. | 427/322 |

*Primary Examiner*—Maria Parrish Tungol

*Attorney, Agent, or Firm*—Ernest G. Szoke; Patrick J. Span

[57] ABSTRACT

The present invention deals with sewing thread lubricants which are resistant to staining fabrics.

14 Claims, No Drawings

SEWING THREAD LUBRICANTS

BACKGROUND OF THE INVENTION

1. Field of the Invention

This invention deals with forming articles of clothing and in particular a method and composition for treating a thread so that the article of clothing is not stained by the thread lubricant.

2. Discussion of the Art Practices

In the commercial manufacture of fabrics the sewing machines are set to operate at an extremely high speed. The high speed sewing machine can cause melting of the thread onto the fabric if no lubricant is employed. It is of course also possible for low melt fabrics to be damaged by the high speed sewing action. Therefore, it is a common practice in the industry to treat sewing thread for high speed sewing with a variety of lubricants to minimize the possibility for thread and fabric damage. In particular, nylon taffeta, a shiny silk-like fabric, is susceptible to melt damage.

The commonly used lubricants such as mineral oil and ordinary fats, present a problem when the article sewn is nylon taffeta. The nylon taffeta is particularly subject to staining by common lubricants and thus there is a need for a non-staining sewing thread lubricant. The reader is directed to U.S. Pat. No. 4,169,905, issued Oct. 2, 1979 to DeLaval et al, and to Japanese Pat. Nos. 54/06,939 and 54/034,446 published respectively on June 14, 1977 and Aug. 18, 1977. These patents discuss various methods of forming sewing thread lubricants and their use. To the extent that each of the foregoing are applicable they are herein incorporated by reference.

Throughout the specification and claims percentages and ratios are given by weight and temperatures are in degrees Celsius unless otherwise noted.

SUMMARY OF THE INVENTION

A sewing thread lubricant composition comprising:

(a) from about 10 parts to about 60 parts by weight of a hardened coconut oil having a melt point of greater than 25° C.;

(b) from about 10 parts to about 60 parts by weight of a member selected from the group consisting of hydrogenated castor oil and hydrogenated tallow oil and mixtures thereof, said member having a melt point of greater than 30° C.; and (c) from about 0 parts to about 60 parts by weight of a normally solid paraffin wax.

The invention also encompasses a process for manufacturing an article of nylon taffeta fabric including the steps of sewing said article using a sewing thread containing thereon a lubricant composition including:

(a) from about 10 to about 60 parts by weight of a hardened coconut oil having a melt point of greater than 25° C.;

(b) from about 10 parts to about 60 parts by weight of a member selected from the group consisting of hydrogenated castor oil and hydrogenated tallow oil and mixtures thereof, said member having a melt point of greater than 30° C.; and (c) from about 0 parts to about 60 parts by weight of a normally solid paraffin wax, wherein said treated thread is highly resistant to staining the nylon taffeta fabric.

DETAILED DESCRIPTION OF THE INVENTION

The present invention as noted in the Summary contains two essential ingredients which are a blend of naturally occuring oils. In one case the oil is treated to harden or hydrogenate the composition and in the second instance the normal degree of unsaturation is retained in the particular oil. A third preferred ingredient in the present invention while not required but which is able to assist in the lubricating function is a paraffin wax.

The first aspect of the present invention to be discussed is that of the hardened coconut oil component. As noted, the coconut oil should have a melt point of greater than 25° C., preferably greater than 35° C. The distribution of carbon atoms from each said fraction within the coconut oil is preferably from about 20% to about 90% by weight of a 12 carbon fraction; from about 8% to about 45% by weight of a 14 carbon fraction; from about 1% to about 45% by weight of a 16 carbon fraction; and, from about 0% to about 15% by weight of a 18 carbon fraction.

The coconut fraction more preferably contains from about 30% to about 80% by weight of a 12 carbon fraction, from about 10% to about 35% by weight of a 14 carbon fraction; from about 2% to about 35% by weight of a 16 carbon fraction; and, from about 0% to about 12% by weight of a 18 carbon fraction.

The degree of unsaturation in the starting coconut oil corresponds to an iodine value of 7.5 to 12 or about 8% to 10% by weight. The iodine value information is obtained from Kirk-Othmer, 3rd Edition, published by John Wiley & Sons, New York herein incorporated by reference. The coconut oil component of the present invention functions basically as the lubricant. Unfortunately, the coconut oil fraction while being an excellent lubricant causes staining of the fabric within a relatively short period of time. Therefore, it was determined to be necessary to stop the otherwise excellent lubricant from causing staining. Suitable sources of component (a) as described above are: Capital City Products Co., Div of Stokely Van Camp, Inc.; Best Foods, a unit of CPC International; and Kraft, Inc. Industrial Foods Division.

The second component to be discussed is a member selected from the group consisting of hydrogenated castor oil and hydrogenated tallow oil and mixtures thereof. Both of these materials contain a small fraction of the oil which is unsaturated. The oils are hydrogenated by conventional technology to raise the melt point to greater than 30° C. and preferably greater than 37.7° C., most preferably the melt point is greater than 40° C. Suitable sources of the hydrogenated oils are from the following manufacturers: Chemol, Inc., Emery Industries, Inc. and A. Gross & Company.

The distribution of fatty acids as each portion of the triglyceride of the hydrogenated tallow are as follows: 2% to 20% of $C_{16}$; 80% to 98% of $C_{18}$; preferably 2.5 to 15% of $C_{16}$; and 85% to 97.5% of $C_{18}$. Non-hydrogenated tallow contains about 30% to about 75% mono, di, and tri unsaturates.

The hydrogenated castor oil is the material obtained by hydrogenating the essentially pure cis-12-hydroxyoctadec-9-enoic acid portion of the triglyceride. Sources of hydrogenated castor oil are: Bunge Corporation and Cas Chem, Inc.

An optional component in the present invention is a normally solid paraffin wax. Typically paraffin wax contains from 20 to 36 carbon atoms and is an essentially linear material having a melting range of 27° C. to 70° C.

The components of the present invention are combined by mixing the materials together using as little heat as possible. It is believed that hydrogenated or hardened fats exhibit superior solubility with the coconut oil due to similarities in chemical structure and melting range which inhibit the release of the lubricant (coconut oil) from the total finish composition. Even though paraffin wax is miscible in the coconut oil, the dissimilar chemical substances tend to disassociate from one another when an adjacent material (nylon tafetta) is available for migration.

As previously noted, a mixture of hydrogenated castor oil and hydrogenated tallow oil may be employed. When this is done it is preferrable that they be used in a mixture of from 90:10 to 10:90. A preferred range for the amount of coconut oil used in the invention is from about 30 parts to about 70 parts together with the hydrogenated castor or hydrogenated tallow at from about 10 parts to about 50 parts by weight. When the paraffin wax is included in the present invention this material may be preferably used at a level from about 10 to about 40 parts. The use of the paraffin assists in further reducing the staining ability of the coconut oil and also adds a small amount of lubricating function to the composition. A preferred melt point range for the paraffin wax is from about 40° C. to about 60° C.

Several additional components may be utilized in combination with the present invention such as small amounts of surfactants such as ethoxylated alcohols, perfumes, additional waxes and non-staining lubricants in minor amounts of the composition.

The products of the present invention are used by applying them to the thread at a level of from about 1% to about 20%, preferably from about 3% to about 10% by weight. The addition of the lubricant is done by the thread manufacturer and it is therefore desirable that the treated thread not be exposed to conditions where the lubricant has the ability to bleed off the thread. A convenient manner of treating the thread is by employing a kiss roll.

The determination of the degree of staining ability of the compositions is conducted by obtaining ten centimeters square nylon taffeta fabric (about 50 to 150 grams per square meter). A small rectangle of approximately two centimeters by seven centimeters is outlined in pencil to define the sample area. The products of the present invention which are normally solid at room temperature (22°-25° C.) are placed within the outlined sample area until the area is essentially covered. At various time intervals the distance of oil staining outside of the rectangle is measured in centimeters on either side of the seven centimeter line up to a maximum distance of 4.0 centimeters.

The following are examples of the present invention.

EXAMPLE I

This Example illustrates the nonstaining performance of two thread lubricants utilizing a blend of hydrogenated tallow glyceride and a 49° C. melting point paraffin (Formulas A & B) versus a third product (Formula C) not containing hydrogenated tallow glyceride. The melt points follow the components.

| Component | Formulas A | B | C |
|---|---|---|---|
| Coconut oil, 43° C. | 50.0 | 40.0 | 50.0 |
| POE (7) C11-C15 alcohol* | 5.0 | 5.0 | 5.0 |
| POE (3) coco alcohol | 5.0 | 5.0 | 5.0 |
| Hydrogenated Tallow Glyceride, 59° C. | 20.0 | 30.0 | — |
| Paraffin wax, 49° C. | 20.0 | 20.0 | 40.0 |
| | 100.0 | 100.0 | 100.0 |

Formulas, A, B, and C were tested for fabric staining as described and the results are as follows:

| Sample | Staining Time (Days) 1 | 2 | 3 | 4 | 8** | 14 |
|---|---|---|---|---|---|---|
| Formula A | 0 | 0 | 0 | 0 | 0.3 cm | 0.8 cm |
| Formula B | 0 | 0 | 0 | 0 | 0 | 0 |
| Formula C | 0 | 1.1 | 1.3 | 1.5 | 4.0 | *** |

Example I at A and B clearly shows the positive influence of hydrogenated tallow glyceride in minimizing the lubricant migration onto the nylon tafetta fabric.

EXAMPLE II

This Example demonstrates the effectiveness of hydrogenated castor oil in reducing lubricant staining onto fabric. The lubricant formulations are:

| Component | Formulas D | E | F |
|---|---|---|---|
| Coconut oil, 43° C. | 50.0 | 50.0 | 50.0 |
| POE (7) C11-C15 alcohol | 5.0 | 5.0 | 5.0 |
| POE (3) coco alcohol | 5.0 | 5.0 | 5.0 |
| Hydrogenated castor oil, 80° C. | 10.0 | 20.0 | 30.0 |
| Paraffin wax, 49° C. | 30.0 | 20.0 | 10.0 |
| | 100.0 | 100.0 | 100.0 |

The staining properties of Formulas D, E, and F were compared to Formula C in Example I and the results are as follows:

| Sample | Staining Time (Days) 1 | 2 | 3 | 4 | 8 | 14 |
|---|---|---|---|---|---|---|
| Formula C | 0 | 1.1 cm | 1.3 cm | 1.5 cm | 4.0 cm | — |
| Formula D | 0 | 0 | 0 | 0 | 1.3 | 1.3 |
| Formula E | 0 | 0 | 0 | 0 | 0 | 0 |
| Formula F | 0 | 0 | 0 | 0 | 0 | 0 |

The data reveals that hydrogenated castor oil is an excellent nonstaining thread lubricant component which is effective at low concentrations.

EXAMPLE III

This Example illustrates that the lubricant and the wax component selection during the formulation of nonstaining thread lubricants are very specific and that both must work together to yield a satisfactory product. The following formulations demonstrate the results of an improper lubricant and/or wax selection:

| Component | Formulas G | H | I | J |
|---|---|---|---|---|
| Coconut oil, 43° C. | 50.0 | 40.0 | — | 40.0 |
| Glycerol trioleate | — | — | 50.0 | — |
| POE (7) C11-C15 alcohol | 5.0 | 5.0 | 5.0 | 5.0 |

-continued

| Component | Formulas G | H | I | J |
|---|---|---|---|---|
| POE (3) coco alcohol | 5.0 | 5.0 | 5.0 | 5.0 |
| Microcrystalline wax, 68° C. | 40.0 | — | — | — |
| Stearyl Stearate | — | 30.0 | — | — |
| Hydrogenated tallow glyceride, 59° C. | — | — | 20.0 | 30.0 |
| Paraffin wax, 49° C. | — | 20.0 | 20.0 | 20.0 |
| | 100.0 | 100.0 | 100.0 | 100.0 |

The staining properties of the above formulations are:

| Sample | Staining Time (Days) 1 | 2 | 3 | 4 | 8 | 14 |
|---|---|---|---|---|---|---|
| Formula G | 0 | 0 | 0.2 cm | 0.2 cm | 0.5 cm | 1.7 cm |
| Formula H | 0 | 0 | 0.2 | 0.5 | 3.2 | 4.0 |
| Formula I | 0 | 0.2 | 0.5 | 0.8 | 2.5 | 2.6 |
| Formula J | 0 | 0 | 0 | 0 | 0 | 0 |

The data in Example III teaches that the use of a high melting point wax (Formula G) will not ensure satisfactory performance. Formula I shows the effects of an improper lubricant selection after preferred waxes are employed. Formula J is an example of a preferred non-staining thread lubricant.

EXAMPLE IV

This Example demonstrates that the addition of paraffin wax is not essential for obtaining satisfactory non-staining properties. The formulas are:

| Component | Formulas K | L |
|---|---|---|
| Coconut oil, 43° C. | 50.0 | 50.0 |
| POE (7) C11-C15 alcohol | 5.0 | 5.0 |
| POE (3) coco alcohol | 5.0 | 5.0 |
| Hydrogenated tallow glyceride, 59° C. | 40.0 | — |
| Hydrogenated castor oil, 80° C. | — | 40.0 |
| | 100.0 | 100.0 |

The staining properties of the above were rated as follows:

| Sample | Staining Time (Days) 1 | 2 | 3 | 4 | 8 | 14 |
|---|---|---|---|---|---|---|
| Formula K | 0 | 0 | 0 | 0 | 0.2 cm | 0.8 cm |
| Formula L | 0 | 0 | 0 | 0 | 0 | 0 |

What is claimed is:

1. A sewing thread lubricant composition comprising:
(a) from about 10 parts to about 60 parts by weight of a hardened coconut oil having a melt point of greater than 25° C.;
(b) from about 10 parts to about 60 parts by weight of a member selected from the group consisting of hydrogenated castor oil and hydrogenated tallow oil and mixtures thereof, said member having a melt point of greater than 30° C.; and
(c) from about 0 parts to about 60 parts by weight of a normally solid paraffin wax.

2. The composition of claim 1 containing from about 15 parts to about 55 parts of component (a).

3. The composition of claim 1 containing from about 10 to about 55 parts by weight of component (c).

4. The composition of claim 3 wherein component (c) contains from about 18 to about 36 carbon atoms.

5. The composition of claim 1 wherein component (b) is present at from about 15 to 55 parts by weight.

6. The composition of claim 3 containing from about 10 parts to about 50 parts by weight of component (c).

7. The composition of claim 1 wherein component (b) is hydrogenated castor oil.

8. The composition of claim 1 wherein component (b) is hydrogenated tallow oil.

9. The composition of claim 1 wherein component (a) has the following weight distribution of carbon atoms in each of the acid fractions of the oil:
(i) from about 30% to about 80% by weight of a 12 carbon fraction,
(ii) from about 10% to about 35% by weight of a 14 carbon fraction,
(iii) from about 2% to about 35% by weight of a 16 carbon fraction, and
(iv) from about 0% to about 12% by weight of a 18 carbon fraction.

10. The composition of claim 1 wherein component (b) is cis-12-hydroxyoctadecanoic acid glyceride.

11. The composition of claim 1 wherein the melt point of component (a) is greater than 35° C.

12. The composition of claim 1 wherein the melt point of component (b) is about 37° C. or greater.

13. The composition of claim 1 where component (c) has a melt point of at least 26° C.

14. A process for manufacturing an article of nylon taffeta fabric including the steps of sewing said article using a treated sewing thread containing thereon a lubricant composition including:
(a) from about 10 to about 60 parts by weight of a hardened coconut oil having a melt point of greater than 25° C.;
(b) from about 10 parts to about 60 parts by weight of a member selected from the group consisting of hydrogenated castor oil and hydrogenated tallow oil and mixtures thereof, said member having a melt point of greater than 30° C.; and
(c) from about 0 parts to about 60 parts by weight of a normally solid paraffin wax,
wherein said treated thread is highly resistant to staining the nylon taffeta fabric.

* * * * *

UNITED STATES PATENT AND TRADEMARK OFFICE

CERTIFICATE OF CORRECTION

PATENT NO. : 4,451,382

DATED : May 29, 1984

INVENTOR(S) : John T. Childers

It is certified that error appears in the above-identified patent and that said Letters Patent are hereby corrected as shown below:

In column 4, after line 23, the following text should be inserted:

-- POE indicates that the named alcohol has been reacted to give a polyoxyethylene adduct having the average degree of alkoxylation shown.

The staining after 8 days of 0.3 cm is considered acceptable.

Sample fully stained. -- .

Signed and Sealed this

*Nineteenth* Day of *February 1985*

[SEAL]

*Attest:*

DONALD J. QUIGG

*Attesting Officer* *Acting Commissioner of Patents and Trademarks*